US006889828B2

(12) United States Patent
Pursely

(10) Patent No.: US 6,889,828 B2
(45) Date of Patent: May 10, 2005

(54) POCKET CADDY FOR CARRYING GOLF ITEMS

(76) Inventor: Denton C. Pursely, P.O. Box 186, Geneva, IN (US) 46740

( * ) Notice: Subject to any disclaimer, the term of this patent is extended or adjusted under 35 U.S.C. 154(b) by 154 days.

(21) Appl. No.: 10/192,306

(22) Filed: Jul. 10, 2002

(65) Prior Publication Data

US 2004/0007485 A1 Jan. 15, 2004

(51) Int. Cl.[7] ..... A63B 57/00
(52) U.S. Cl. ..... 206/315.1; 206/38; 224/918
(58) Field of Search ..... 206/38, 315.1; 224/681, 918, 919; 473/408

(56) References Cited

U.S. PATENT DOCUMENTS 3,556,364 A * 1/1971 Maretka ..... 224/191
3,620,426 A 11/1971 Hatch
3,669,250 A * 6/1972 Maretka ..... 206/234
3,674,189 A * 7/1972 Walbeck ..... 206/223
3,753,519 A 8/1973 Gammon
4,129,237 A 12/1978 Grinder
4,151,937 A * 5/1979 Jarosh et al. ..... 224/666
4,736,877 A 4/1988 Clark
4,886,196 A 12/1989 Plummer
4,960,239 A 10/1990 Wait
4,974,842 A 12/1990 Widman
5,054,777 A 10/1991 Borden et al.
5,226,647 A 7/1993 Notarmuzi
5,295,683 A 3/1994 Tate
5,341,975 A * 8/1994 Marinescu ..... 224/666
6,173,451 B1 * 1/2001 DeVincenzi ..... 2/162
2002/0187861 A1 * 12/2002 Jacome ..... 473/408
2003/0006154 A1 * 1/2003 Chen ..... 206/315.9

* cited by examiner

*Primary Examiner*—David T. Fidei
(74) *Attorney, Agent, or Firm*—Butzel Long

(57) ABSTRACT

A golf accessory caddy that includes a pouch that is configured to receive therein a divot tool so that prongs of the divot tool extend outward from the bottom of the pouch, thereby enabling use of the divot tool without removing the divot tool from the pouch. The divot tool can be removably or non-removably secured in the pouch. An inner compartment of the pouch is configured to receive and store therein a golf ball marker, which can be accessed by manipulating a closure provided in the pouch.

20 Claims, 3 Drawing Sheets

POCKET CADDY FOR CARRYING GOLF ITEMS

TECHNICAL FIELD

The present invention generally relates to golf paraphernalia, and more particularly to a golf accessory caddy for receiving, organizing and carrying therein several golf items.

BACKGROUND ART

While playing golf, a golfer utilizes a number of accessories to follow proper etiquette, such as a small, often favorite maker for marking the ball on the green and a divot tool for repairing divots on the green from approach shots. Another accessory that all golfers use is a tee that that supports a golf ball for driving.

The small accessories that a golfer utilizes while playing golf can be used quite frequently. Therefore, it can be inconvenient to store and carry such items in a golf bag, which is often at a remote location from the golfer when accessories are needed.

The practical choices for the golfer are to either carry numerous accessories in the pockets of his or her clothing or to utilize any of a number of accessory carries that are currently available. Carrying accessories in the pockets of a golfer's clothing is generally not a favorable option, because many golf accessories such as divot repair tools and tees have sharp portions. Such sharp portions can jab or poke a golfer at times and adversely affect his or her swing while driving, chipping or putting the ball. Otherwise, such sharp portions can damage a golfer's clothing. Accessories that are of a small size, such as ball markers, make them difficult to locate among other objects that may be in a golfer's pockets.

There are a number of accessory carriers that have been developed for golfers. Examples of such accessory carriers and related items can be found in U.S. Pat. No. 3,620,426 to Hatch, U.S. Pat. No. 3,753,519 to Gammon, U.S. Pat. No. 4,129,237 to Grinder, U.S. Pat. No. 4,736,877 to Clark, U.S. Pat. No. 4,886,196 to Plummer, U.S. Pat. No. 4,960,239 to Wait, U.S. Pat. No. 4,974,842 to Tamaki et al., U.S. Pat. No. 5,054,777 to Borden et U.S. Pat. No. 4,886,647 to Notarmuzi, U.S. Pat. No. 5,295,683 to Tate, U.S. Pat. No. 5,782,708 to Kimball, Jr., U.S. Pat. No. 5,799,853 to Brewster, U.S. Pat. No. 5,842,621 to Gschwimd, U.S. Pat. No. 6,022,280 to Arenburg et al., U.S. Pat. No. 6,095,934 to Ohama, U.S. Pat. No. 6,102,201 to Marston et al., and U.S. Pat. No. 6,202,911 to Freer.

The present invention is directed to a pocket caddy for carrying golf accessories that can conveniently be clipped to a golfer's belt or golf bag for easy access to frequently used golf accessories.

DISCLOSURE OF THE INVENTION

According to various features, characteristics and embodiments of the present invention which will become apparent as the description thereof proceeds, the present invention provides a golf accessory caddy which includes:

a pouch having a front, a back, opposed sides, a bottom, a top and a closure; and a divot tool having a body portion and two prongs that extent from the body portion, the divot tool secured in the pouch so that the body of the divot tool is contained in the pouch and the prongs of the divot tool extend out from the bottom of the pouch.

The present invention further provides a golf accessory caddy which comprises the combination of a pouch defining an inner compartment for receiving a ball marker therein and a divot tool having a pair of prongs which is secured in the pouch so that prongs of the divot tool extend outward from a bottom portion of the pouch.

According to alternative embodiments of the present invention, the divot tool can be removably or non-removably secured in the pouch and a bottom portion of the pouch can extend between the prongs of the divot tool.

The pouch includes a closure such as a closure flap which can be opened to access a ball marker which can be stored in an inner compartment defined by the pouch. When a closure flap is used, it can be provided with one or more apertures for receiving and holding one or more golf tees therein.

BRIEF DESCRIPTION OF DRAWINGS

The present invention will be described with reference to the attached drawings which are given as non-limiting examples only, in which.

BEST MODE FOR CARRYING OUT THE INVENTION

The present invention is directed to a pocket caddy for carrying golf items which is also referred to herein as a golf accessory caddy. The golf accessory caddy of the present invention is configured so that it can be removably attached to the clothing, e.g., belt, belt loop, etc. of a golfer, or to a golf bag, or else placed in a golfer's pocket.

The golf accessory caddy of the present invention includes a closable pouch into which is integrated a divot tool that can be non-removably secured in the pouch or, alternatively, removably/replaceably secured in the pouch. As described below, the pouch is configured so that when the divot tool is positioned within the pouch, the divot tool can be used in its customary manner to replace divots, without removing the divot tool from the pouch.

The pouch includes a compartment and a closure so that a ball marker can be kept in the pouch and removed for use as desired. According to one embodiment, the closure comprises a flap that defines the top of the golf accessory caddy which top portion can be used in conjunction with the divot tool to provide a support for resting the handle of a golf club on so as to keep the handle off the turf where it can become soiled or wet. The top portion of the golf accessory caddy can be provided with a ring to which a suitable clip can be used to removably attach the golf accessory caddy to a golfer's clothing, or to a golf bag. The flap of the closure or another portion of the top of the couch can include one or more apertures therein to receive and hold golf tees therein.

Figure 1:
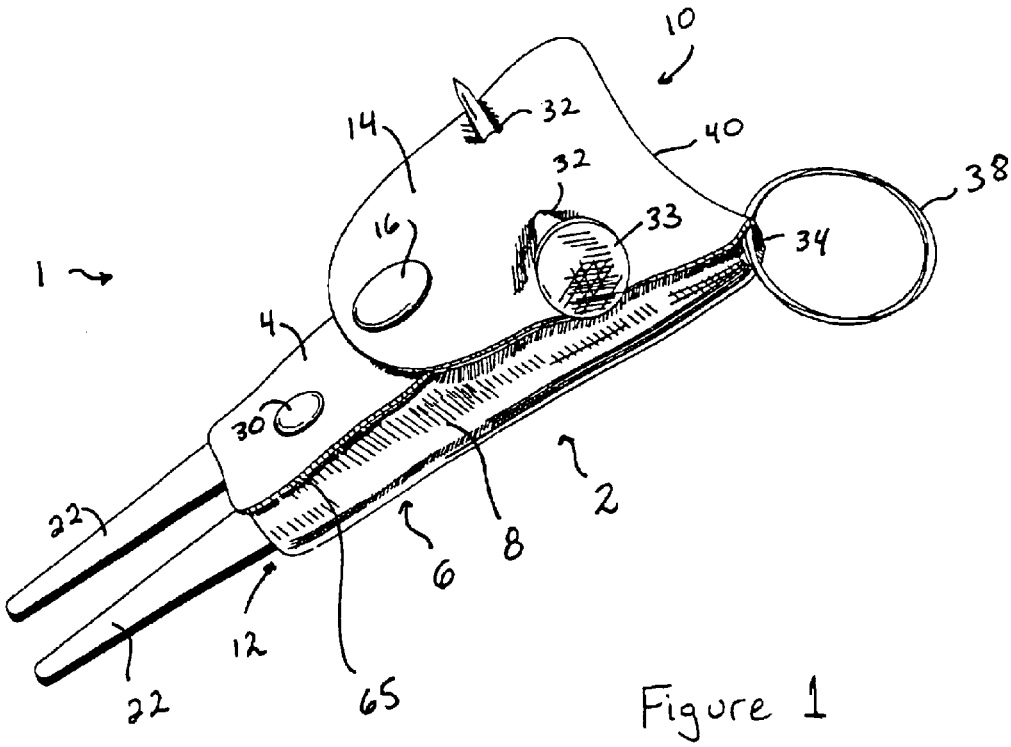
FIG. 1 is a perspective view of the golf accessory caddy according to one embodiment of the present invention.

FIG. 1 is a perspective view of the golf accessory caddy according to one embodiment of the present invention. The golf accessory caddy generally identified by reference numeral 1 includes a pouch 2 having an inner compartment 3 (see FIG. 4). The pouch 2 includes a front 4, back 6, opposed sides 8, a top 10 and a bottom 12 in addition to a closure flap 14. The closure flap 14 can be secured in a closed position by means of a snap mechanism that includes cooperating catch and base portions 16 and 18 on the closure flap 14 and the lower portion of the front 4 of the pouch 2 respectively. The use of a snap mechanism is exemplary and it to be understood that other closure mechanisms such as, but not limited to, buttons, ties, Velcro® can be used to secure the closure flap 14 it its closed position as depicted in FIG. 1.

As will be discussed in more detail below, the front 4 of the pouch 2 depicted in FIG. 1 presents an edge 65. This is because the material blank 60 from which the pouch 2 is manufactured has overlapping front portions 4' when assembled.

The prongs 22 of a divot tool 24 (FIG. 3) extend outward from the bottom 12 of the pouch 2. The divot tool 24 itself can be of conventional design and, as shown best in FIGS. 3 and 4 has a flat profile, a generally rectangular body 26 with curved corners 27, and two substantially parallel prongs 22 that have outer inwardly tapered sides 28. In alternative embodiments, the divot tool 24 can be of other conventional designs or configured to be more complementarily shaped to the configuration of the inner compartment 3 of the pouch 2. As is known, the prongs 22 of the divot tool 24 are used to repair divots that result when a golf club undercuts a golf ball too much during a swing. A mechanical fastener 30 such as a rivet, screw and nut, etc. is depicted in FIG. 1. As discussed below, mechanical fastener 30 is used to secure the two overlapping front portions 4' (FIG. 5) of the material blank 60 that form the front 4 of the pouch 2 and a bottom flap 68 of the material blank 60.

The closure flap 14 is provided with one or more pairs of aligned apertures 32 (one pair shown) which are sized and configured, e.g. properly spaced, to receive and hold therein golf tees 33 (one shown). One of the top corners 34 of the pouch 2 includes an aperture 36 that can be reinforced with a grommet as depicted. A connecting ring 38, e.g. a split ring, can be coupled through aperture 36 and used to connect a conventional clip, hook, or other similar holding means to the pouch 2 that can be removably attached to a golfer's belt, a belt loop of a golfer's pants, a golf bag, etc.

Figure 2:
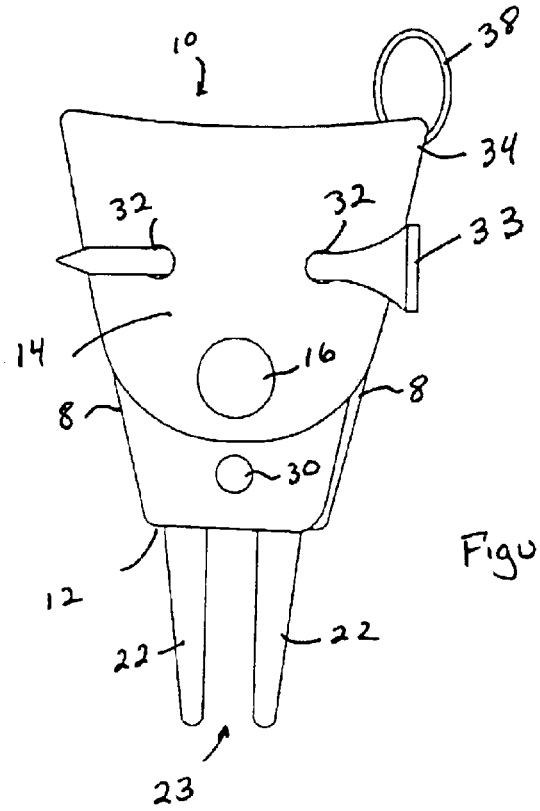
FIG. 2 is a front view of the golf accessory caddy of FIG. 1.

FIG. 2 is a front view of the golf accessory caddy of FIG. 1. FIG. 2 depicts the top edge or surface 40 of the golf accessory caddy 1 as having a slight concave contour with the top corners 34 being slightly higher than the center of the top 10. The concave shape of the top 10 of the golf accessory caddy 1 can function in conjunction with the divot tool 24 as a support for resting the handle of a golf club on so as to keep the handle off the turf where it can become soiled or wet. In this regard, the prongs 22 of the divot tool 24 can be pushed in the ground so that the top 10 of the golf accessory caddy 1 is stable enough to support the weight of a golf club handle to be rested thereon.

Figure 3:
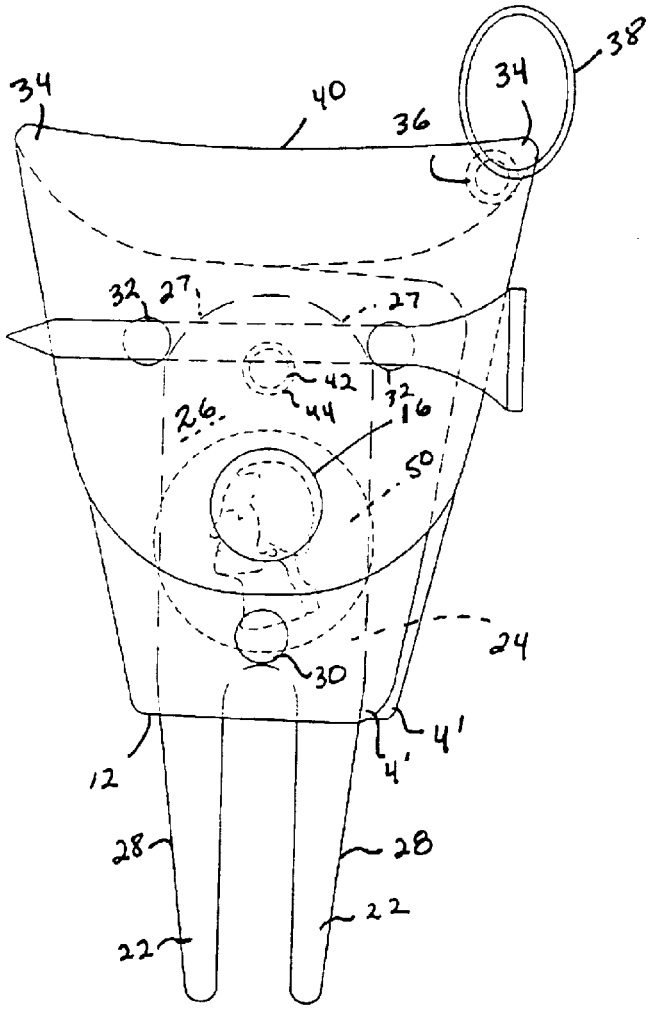
FIG. 3 is a front cut-away view of the golf accessory caddy according of FIG. 1.

FIG. 3 is a front cut-away view of the golf accessory caddy according of FIG. 1. In FIG. 3, the divot tool 24 is shown as including a through-hole 42. According to one embodiment of the present invention in which the divot tool 24 is non-removably secured in the pouch 2, through-hole 42 can be used to secure the divot tool 24 within pouch 2 by providing a mechanical fastener 44 such as a rivet, screw and nut, etc. that passes through through-hole 42 of divot tool 24 and aligned through-holes 76 in the overlapping front portions 4' of material blank 60 and through-hole 78 in the bottom flap 68 of material blank 60 (see FIGS. 4 and 5)

The pouch 2 has an inner compartment 3 (see FIG. 4) that can receive a ball marker 50 such a coin (as depicted), a token, or other small relatively thin article.

The phantom lines in FIG. 3 illustrate elements and structure that is within the pouch 2 of the golf accessory caddy 1. FIG. 3 provides, in phantom, an illustration of how front flaps 4' of the material blank 60 are overlapped to form pouch 2 when assembled.

Figure 4:
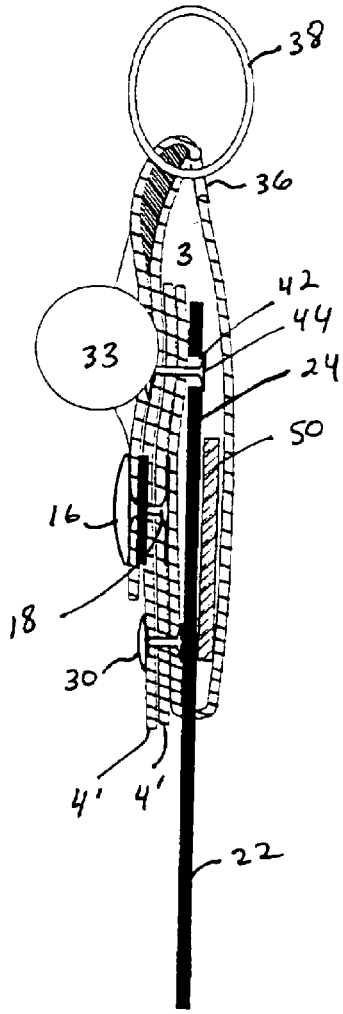
FIG. 4 is a cross-sectional side view of the golf accessory caddy of FIG. 5.
Figure 5:
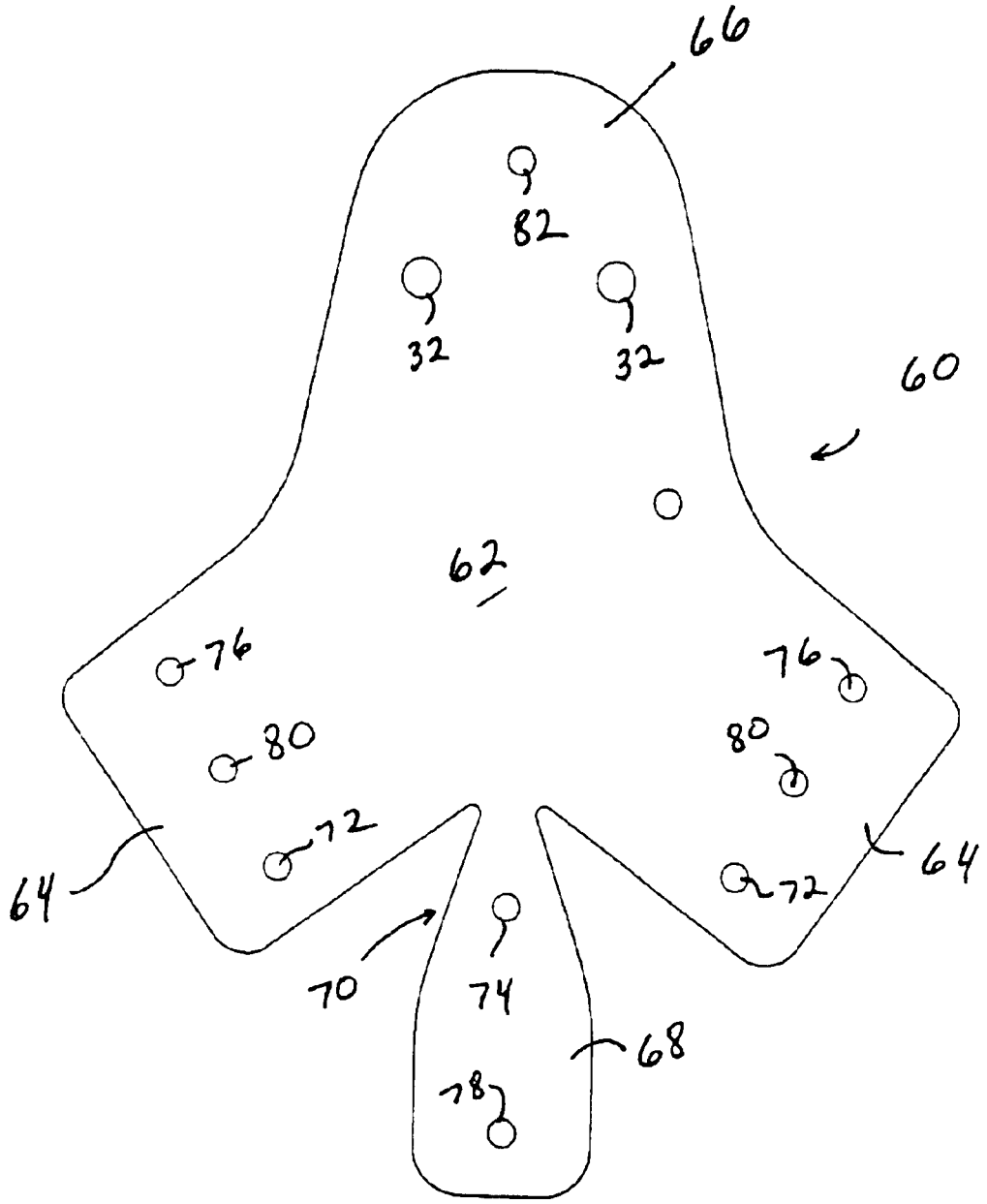
FIG. 5 depicts a blank cut of material from which the golf accessory caddy of FIG. 1 can be manufactured.

FIG. 4 is a cross-sectional side view of the golf accessory caddy of FIG. 5. Figure depicts how the overlapping front portions 4' and bottom flap 68 of material blank 60 (FIG. 5) are held together by mechanical fastener 30 and how the overlapping front portions 4' and bottom flap 68 of material blank 60 (FIG. 5) and divot tool 24 are held together by mechanical fastener 44. FIG. 4 also depicts how the cooperating catch and base portions 16 and 18 of the snap mechanism are coupled to the closure flap 14 and to lower portions of the overlapping front portions 4' of the front 4 of the pouch 2. As seen in FIG. 4 the pouch 2 includes a compartment 3 that can receive a ball marker 50 behind the divot tool 24.

FIG. 5 depicts a blank cut of material from which the golf accessory caddy of FIG. 1 can be manufactured. The material blank 60 includes a central portion 62 that defines the back 6 of the golf accessory caddy 1, front side portions 64 which define overlapping front portions 4', a top flap 66 which defines flap closure 14 and a bottom flap 68 which defines bottom 12 of pouch 2. The material blank 60 is configured so that the narrow portion 70 of the bottom flap 68 passes through the space 23 provided between the prongs 22 of divot tool 24. Through-holes 72 and 74 of material blank 60 receive mechanical fastener 30 and through-holes 76 and 78 of material blank 60 receive mechanical fastener 44. Through-holes 80 receive the base member 18 of the cooperating portions of the snap mechanism, and through-hole 82 receives the catch member 16 of the cooperating portions of the snap mechanism.

The material from which the pouch is made can be natural or artificial leather, cloth, including canvas, a synthetic material such as vinyl or a flexible plastic material, or any other reasonable tough material that can be folded to form and assembly the pouch and be resistance to tearing when pulled, as for example to pull the snap mechanism or other closure means open.

It is to be understood that the material blank is not necessary limited to the exact shape depicted in FIG. 5. The depicted shape is merely exemplary and other shapes can be used. For example, the front side portions can have other than the rectangular shape shown and can extend more horizontally to give the resulting pouch a more rectangular shape than the tapered shape depicted in FIG. 2. Other embodiments can be provided in which the top flap is longer, shorter, rectangular, etc. In further embodiments the closure flap could be eliminated and the inner top surfaces of the pouch could be provided with a Velcro® or Magic Tape® closing mechanism or a zipper or a spring steel closure mechanism, or other known closure mechanism.

In alternative embodiments, the pouch can be made from a combination of separate ones pieces of a material rather than the unitary material blank depicted in FIG. 5. In such a case, the separate pieces which can include for example front side portions 64 can be sewn, stitched, glued, etc. to the central portion 62 of the material blank 60 depicted in FIG. 5 rather than folded along the sides of the pouch. In other embodiments, a single front flap could be provided having an edge that can be sewn, stitched, glued, etc. to the opposite side edge(s) of the pouch.

In other alternative embodiments, the divot tool depicted in the figures can have a different, conventional shape to that shown. In addition, it is within the scope of the present invention to provide a divot tool having a central body that is more complimentarily shaped to the inner compartment of the pouch, including one that has an open central portion that occupies less of the center of the inner compartment of the pouch and is coupled to the overlapping front portions of the pouch by more than one mechanical fastener.

The golf accessory caddy of the present invention can be readily customized or personalized. For example, one or more of the cover of the exposed cooperating snap mechanism, and outer surface portion of the pouch or the ball marker can be provided with a logo, a golfer's initials, or another emblem or mark.

Although the present invention has been described with reference to particular means, materials and embodiments, from the foregoing description, one skilled in the art can easily ascertain the essential characteristics of the present invention and various changes and modifications can be made to adapt the various uses and characteristics without departing from the spirit and scope of the present invention as described above.

What is claimed is:

1. A golf accessory caddy which comprises:

a pouch having a front, a back, opposed sides, a bottom, a top and a closure; and a divot tool having a body portion and two prongs that extent from the body portion, the divot tool secured in the pouch so that the body of the divot tool is contained in the pouch and the prongs of the divot tool extend out from the bottom of the pouch.

2. A golf accessory caddy according to claim 1, wherein the divot tool is non-removably secured in the pouch.

3. A golf accessory caddy according to claim 1, wherein a portion of the bottom of the pouch extends between the prongs of the divot tool.

4. A golf accessory caddy according to claim 1, wherein the pouch defines a compartment for receiving a golf ball marker.

5. A golf accessory caddy according to claim 1, wherein the top of the pouch includes a closure flap.

6. A golf accessory caddy according to claim 1, wherein a portion of the top of the pouch is provided with an aperture for coupling a holding means thereto.

7. A golf accessory caddy according to claim 1, wherein the top of the pouch has a concave shape.

8. A golf accessory caddy according to claim 1, wherein the front of the pouch comprises overlapping front portions.

9. A golf accessory caddy according to claim 1, wherein the opposite sides of the pouch are tapered.

10. A golf accessory caddy according to claim 1, wherein the front, back, opposed sides, bottom, and top of the pouch are formed from an integral piece of material.

11. A golf accessory caddy according to claim 1, wherein the pouch is provided with at least one aperture to receive and hold a golf tee therein.

12. A golf accessory caddy which comprises the combination of:

a pouch defining an inner compartment for receiving a ball marker therein and having a bottom portion; and a divot tool having a body portion from which a pair of prongs extend, said divot tool being secured in the pouch in a fixed manner so that the body portion of the divot tool is concealed within the pouch and the prongs of the divot tool extend outward from a bottom portion of the pouch.

13. A golf accessory caddy according to claim 12, wherein the pouch is made from a non-rigid material.

14. A golf accessory caddy according to claim 13, wherein the pouch is made from a flexible material.

15. A golf accessory caddy according to claim 12, wherein divot tool is non-removably secured in the pouch.

16. A golf accessory caddy according to claim 12, wherein the divot tool is removably secured in the pouch.

17. A golf accessory caddy according to claim 12, wherein the pouch comprises a front, a back, opposed sides, a bottom, a top and a closure.

18. A golf accessory caddy according to claim 17, wherein the wherein the front, back, opposed sides, bottom, and top of the pouch are formed from an integral piece of material.

19. A golf accessory caddy according to claim 12, wherein the pouch includes a top closure flap.

20. A golf accessory caddy according to claim 12, wherein a bottom portion of the pouch extends between the prongs of the divot tool.

* * * * *